United States Patent [19]

Taylor

[11] Patent Number: 4,998,834

[45] Date of Patent: Mar. 12, 1991

[54] SLIDE ASSEMBLY FOR MOUNTING A PRINT RIBBON

[75] Inventor: Bruce E. Taylor, Tipp City, Ohio

[73] Assignee: Monarch Marking Systems, Inc., Dayton, Ohio

[21] Appl. No.: 424,788

[22] Filed: Oct. 20, 1989

[51] Int. Cl.[5] ..... B41J 33/12

[52] U.S. Cl. ..... 400/247; 400/246

[58] Field of Search ..... 400/120, 207, 208, 208.1, 400/236, 236.1, 236.2, 242, 243, 244, 245, 246, 247, 248, 248.1, 248.2, 250, 692, 249, 250; 101/336

[56] References Cited

U.S. PATENT DOCUMENTS

| | | | |
|---|---|---|---|
| 2,464,042 | 3/1949 | Inskeep | 101/336 |
| 2,764,934 | 10/1956 | Kaplan | 101/336 |
| 3,710,915 | 1/1973 | Teichmann et al. | 400/242 |
| 4,492,159 | 1/1985 | Clark | 101/336 |
| 4,569,606 | 2/1986 | Hoyes | 400/208 |
| 4,776,714 | 10/1988 | Sugiura et al. | 400/208 |
| 4,874,262 | 10/1989 | Yokoi et al. | 400/208 |

FOREIGN PATENT DOCUMENTS

| | | | |
|---|---|---|---|
| 152889 | 7/1987 | Japan | 400/208 |

*Primary Examiner*—David A. Wiecking
*Attorney, Agent, or Firm*—Joseph J. Grass

[57] ABSTRACT

There is disclosed a printer with an improved arrangement to facilitate changing of inking ribbons. A slide assembly is placed in a load position and loaded with an inking ribbon supply roll. Thereafter, the inking ribbon is threaded about guides. With the print head and the platen of the printer separated, the slide assembly is slid to a printing position where the inking ribbon is disposed in space between the print head and the platen. Thereafter, the print head and platen are moved relatively together so that the printer is now able to print on a record medium.

26 Claims, 4 Drawing Sheets

SLIDE ASSEMBLY FOR MOUNTING A PRINT RIBBON

BACKGROUND OF THE INVENTION

1. Field of the Invention

This invention relates to the field of printers and to method of loading an inking ribbon into a printer.

2. Brief Description of the Prior Art

Co-owned U.S. Pat. No. 4,776,714 granted on Oct. 11, 1989 to Ikuzo Sugiura et al relates to the printer used with the present invention and the disclosure of U.S. Pat. No. 4,776,714 is incorporated herein by reference. This patent discloses a printer equipped with an ink ribbon cassette. U.S. Pat. Nos. 2,464,042; 2,764,934; 3,710,915; and 4,492,159 are also made of record.

SUMMARY OF THE INVENTION

The invention relates to an improved printer which is easy to load and unload with inking ribbon without the use of an inking ribbon cassette, and it also relates to an improved method of loading an inking ribbon into a printer.

It is a feature of the invention to provide an arrangement by which an inking ribbon supply roll can be loaded into a printer and by which the inking ribbon can be threaded through its normal path but away from the print head and its cooperating platen. This is particularly useful when the inking ribbon is wide. After the inking ribbon has been threaded along the path, the inking ribbon is shifted into a space between the print head and the platen. Thereafter, the print head and platen can be moved relatively toward each other for printing on a record medium. This separation of the loading function of the inking ribbon into two stages obviates difficulties encountered in attempting to load an inking ribbon cassette and simultaneously position the inking ribbon between the print head and the platen.

In accordance with a specific embodiment of the improved method of the invention, the method involves providing an inking ribbon wound into a supply roll, providing a take-up spool, providing a printer having a print head and a platen, the print head and the platen being relatively movable between a printing position and an open position, the print head and the platen being spaced apart in the open position to provide clearance space into which a portion of the inking ribbon is insertable, the printer having a supply spindle, a take-up spindle and guides mounted for shifting movement as a unit, the guides providing a guide path for the inking ribbon, a portion of the guide path being aligned with but spaced from the clearance space during threading of the ink ribbon along the path, inserting the supply roll onto the supply spindle, inserting the take-up spool onto the take-up spindle, thereafter threading the inking ribbon about the guides along the path, thereafter shifting the supply and take-up spindles and the guides as a unit to bring the aligned portion of the inking ribbon into the clearance space, and thereafter moving the print head and platen into the printing position with the inking ribbon in inking contact with a record medium.

In accordance with a specific embodiment of the printer there is provided a frame, a print head mounted on the frame, a platen cooperable with the print head to print on a record medium, the print head and the platen being relatively movable between an open position in which the print head and the platen are spaced apart to provide clearance space and a printing position, a supply roll spindle for receiving an inking ribbon wound in roll form, a driven take-up spindle about which spent ribbon is wound, means for guiding the inking ribbon along a path from its roll to the take-up spool, and an arrangement for movably mounting the spindles and the guide means as a unit between an inking ribbon threading position where the inking ribbon is spaced from the clearance space and an inking position within the clearance space.

DETAILED DESCRIPTION OF THE PREFERRED EMBODIMENT

Figure 1:
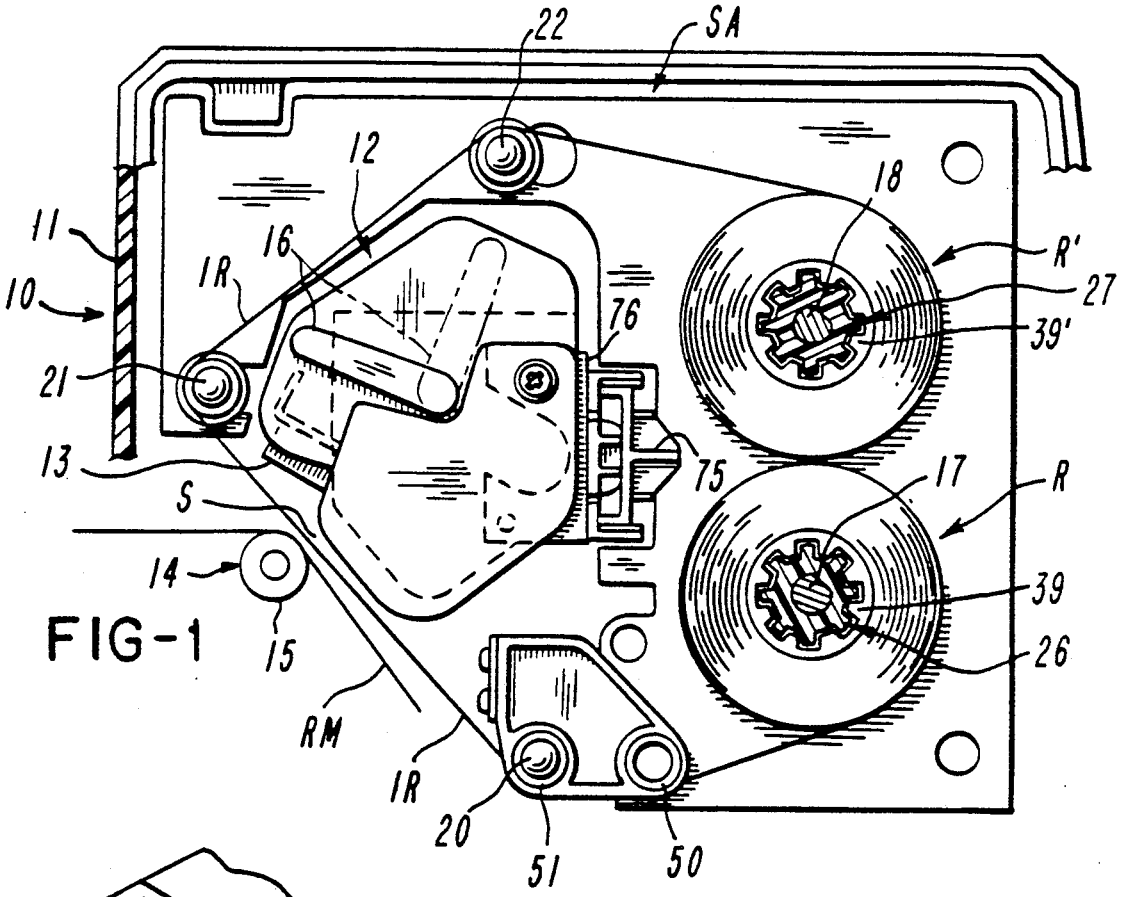
FIG. 1 is a fragmentary front elevational view of a printer embodying the invention.

With reference to FIG. 1, there is shown a printer generally indicated at 10 including a housing or frame 11 to which a printing mechanism generally indicated at 12 is mounted. The printing mechanism 12 includes a cantilever-mounted thermographic or thermal print head 13 and a platen generally indicated at 14 in the form of a platen roll 15. FIG. 1 shows the print head 13 in an open, inoperative position spaced from the platen roll 15 by a gap or clearance space S. By pivoting a lever 16 clockwise, the print head 13 is moved toward the platen roll 15 into printing cooperation with the platen roll 15 as in U.S. Pat. No. 4,776,714. The space S allows the inking ribbon IR and record medium RM to be inserted between the print head 13 and the platen roll 15.

Figure 2:
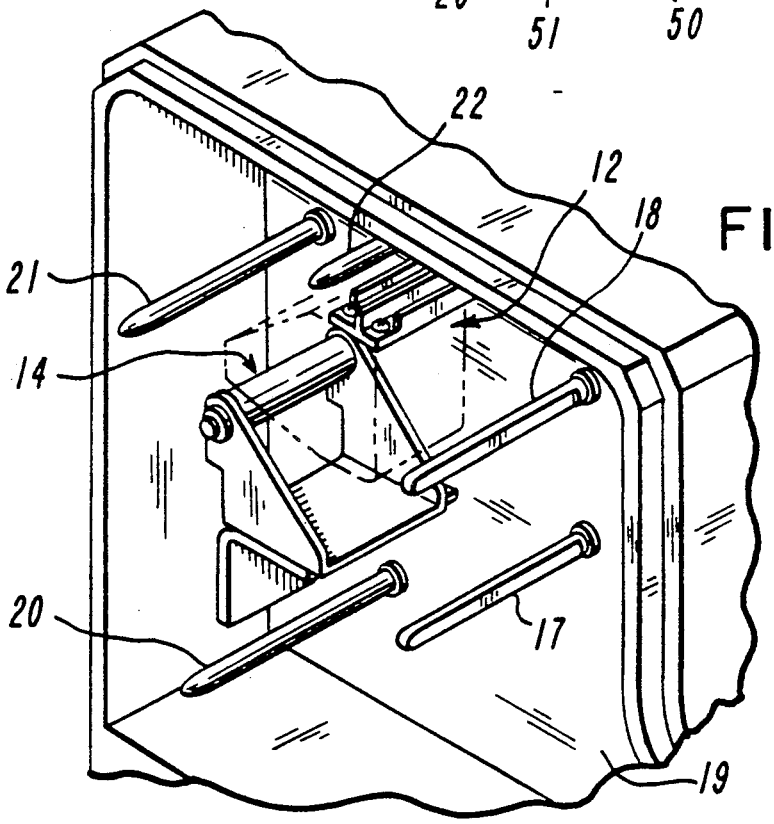
FIG. 2 is a fragmentary perspective view of the printer shown in FIG. 1.

With reference to FIG. 2, there is shown a supply roll shaft 17 which is D-shaped in construction. A continuous braking force is applied to the shaft 17. A take-up shaft 18 is D-shaped in construction. During advance of the record medium RM, the shaft 18 is driven to advance the inking ribbon IR. The shafts 17 and 18 are parallel and are rotatably mounted in a vertically extending frame plate 19. Fixedly secured to the frame plate 19 are parallel mounting pins 20, 21 and 22.

Figure 3:
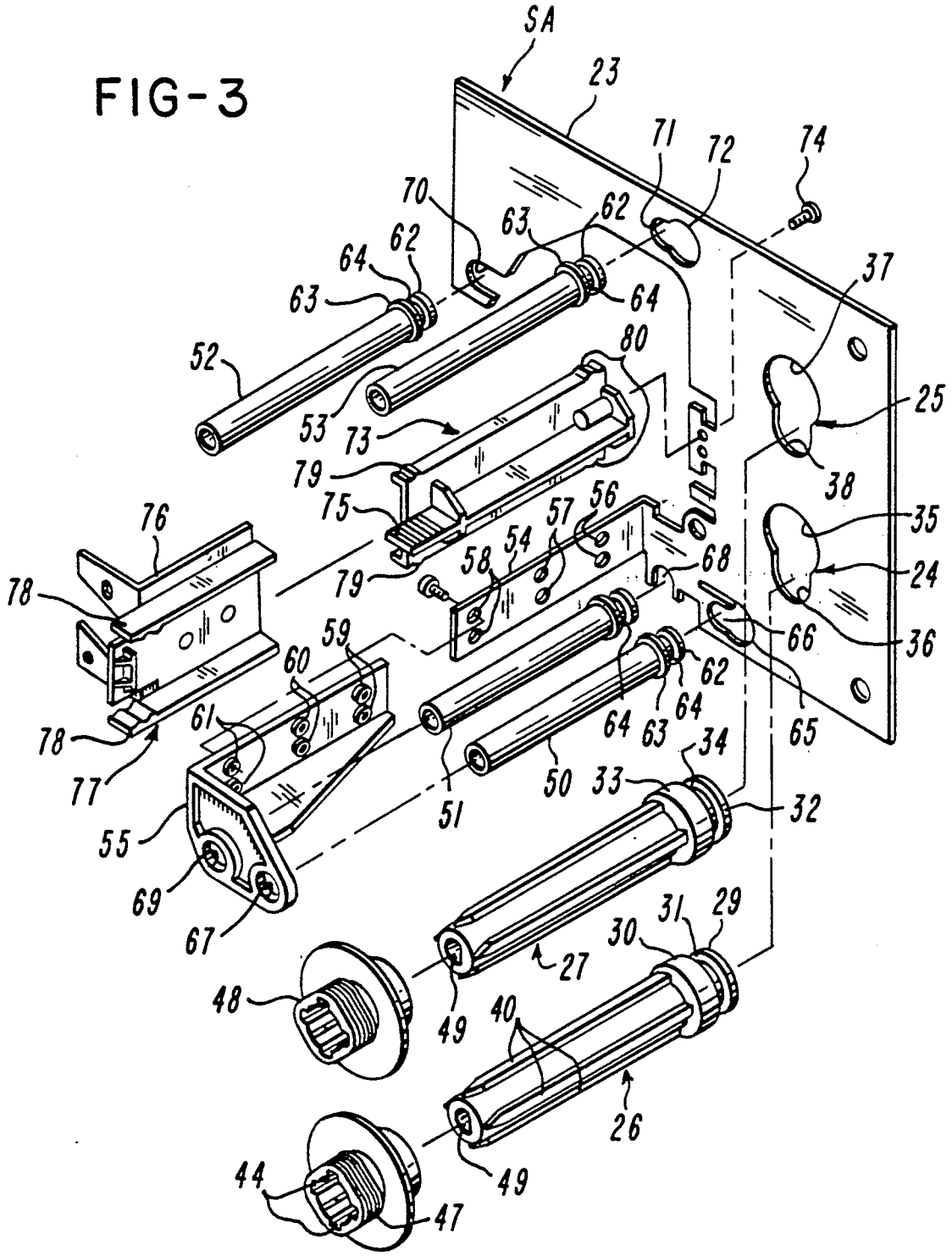
FIG. 3 is an exploded perspective view of an improved arrangement by which an inking ribbon can be easily threaded and subsequently moved to its operating or inking position.

With reference to FIG. 3, there is shown an arrangement by which the inking ribbon IR can be readily threaded and moved to its operating or inking position. A mounting plate 23 has a pair of vertically spaced keyhole-shaped openings 24 and 25. The opening 24 mounts a supply roll spindle generally indicated at 26 and the opening 25 mounts a take-up spindle 27. The spindle 26 has a pair of spaced flanges 29 and 30 which define an intervening groove 31. The spindle 27 has a pair of spaced flanges 32 and 33 which define an intervening groove 34. The opening 24 has an enlarged portion 35 through which the flange 29 of the spindle 26 can be inserted. The opening 24 also has a mounting portion 36 rotatably received in the groove 31. The opening 25 has an enlarged portion 37 through which the flange 32 of the spindle 27 can be inserted. The opening 25 also has a mounting portion 38 rotatably received in the groove 34.

Figure 4:
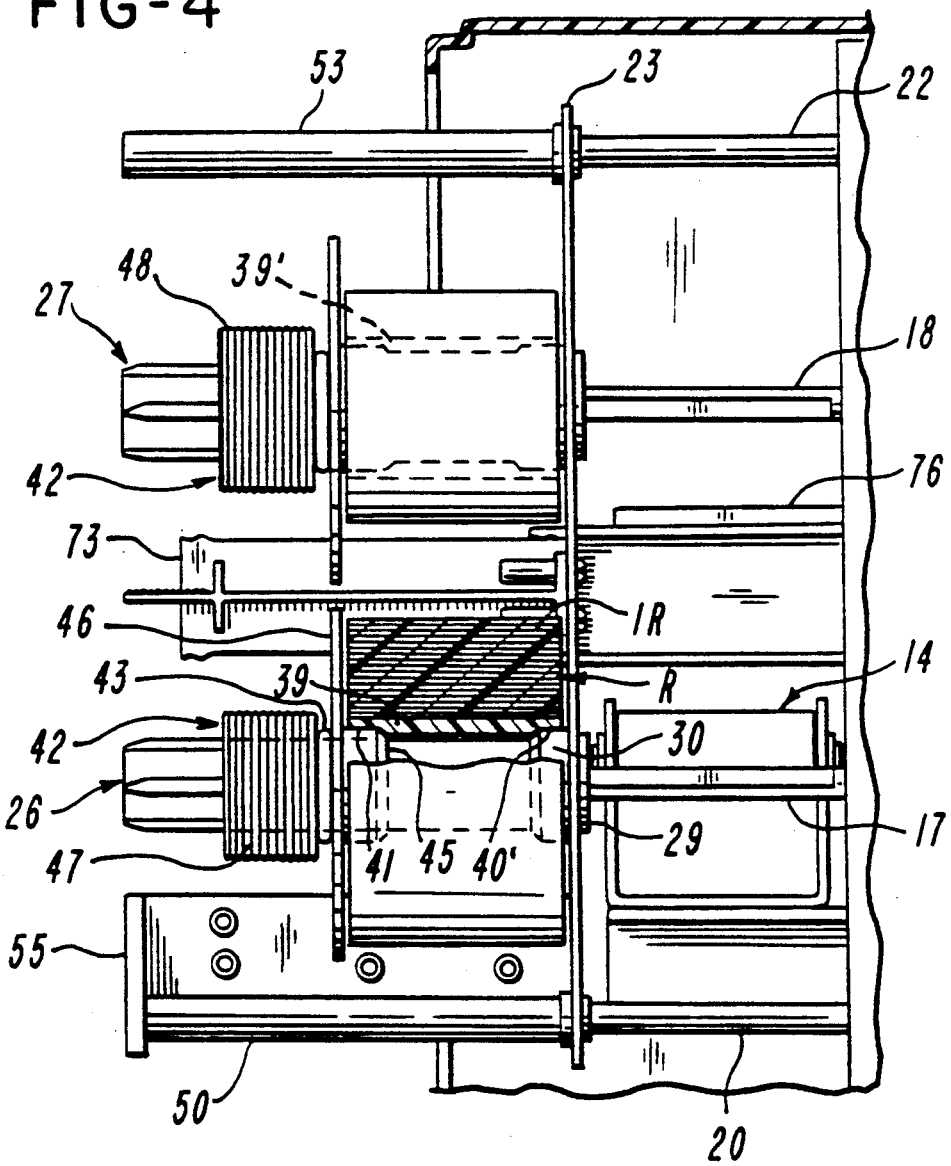
FIG. 4 is an elevational view showing the mounting arrangement in the inking ribbon threading position, taken from the right side of FIG. 1.

With reference to FIGS. 1 and 4, an inking ribbon supply roll R is securely mounted on an internally splined supply roll spool 39 so that there is no relative rotation between the roll R and the spool 39. As shown, the spindle 26 has external splines 40 in keying relationship, preferably loosely, with the internally splined spool 39. The flange 30 is larger than the diameter of the spindle 26 at the splines 40. The flange 30 is received in an enlarged annular groove or recess 40′ in one end portion of the spool 39. The spool 39 also has an enlarged annular groove or recess 41 in its other end portion. The recesses 40′ and 41 are of the same diameter and length. A retainer generally indicated at 42 is frictionally held onto the spindle 26 by an O-ring 43 which extends into contact with splines 40 at four spline grooves 44. The retainer 42 has a sleeve portion 45 received in the recess 41. The flange 30 and the sleeve portion 45 support the spool 39, whereas the spline connection provided by the splines 40 positioned in internally splined spool 39 is solely for the purpose of traction or keying between the spindle 26 and the supply roll spool 39. It should be noted that the flange 30 is longer than the recess 40′ so that neither the spool 39 nor the inking ribbon IR can rub on the metal plate 23 as the spool 39 and the roll R turn as a unit. Likewise, the sleeve 45 is longer than the recess 41 so that the inking ribbon IR cannot rub on the flange 46. The retainer 42 also includes a manually engageable portion 47 by which the retainer 42 can be manually grasped and inserted onto or removed from the spindle 26.

The spindles 26 and 27 are identical, the spools 39 and 39′ are identical, and the spindle 27 is provided with a retainer 42 identical to the other retainer 42. Accordingly, the spindle 27, the spool 39′ and the retainer 48 are not described in further detail.

The D-shaped shafts 17 and 18 are received in respective D-shaped bores 49 in respective spindles 26 and 27. The spindles 26 and 27 are thus keyed to respective shafts 17 and 18 but are slidable along straight lines on respective shafts 17 and 18. The shaft 17 applies a braking force or drag to the spindle 26 which applies a braking force or drag to the spool 39 and in turn to the inking ribbon roll R. This maintains tension in the inking ribbon IR between the roll R and the place where the inking ribbon IR is rewound into a roll R′ on a take-up spool 39′. The take-up spool 39′ is driven by the take-up spindle 27 which is driven by take-up shaft 18. Thus, as the record medium RM is advanced the ribbon IR is maintained under tension.

The inking ribbon IR is guided by four spaced, parallel identical guides 50, 51, 52 and 53. The guides 50 through 53 are shown to be rotatable tubular guides or guide rolls. The guides 51 through 53 are mounted on the pins 20 through 22. An elongate tab or projection 54 formed integrally with the plate 23 mounts a bracket 55. The projection 54 has sets of holes 56, 57 and 58 and the bracket 55 has sets of holes 59, 60 and 61. The bracket 55 is illustrated as being secured to the projection 54 by screws passing through sets of aligned holes 58 and 61. Each roller 50 through 53 has a flange 62 and a flange 63 spaced apart by an intervening groove 64. One end portion of the guide 50 is insertable into an opening 65 and its groove 64 is rotatably received in reduced portion 66. The other end portion of the guide 50 is rotatably received in an annular hole 67 in the bracket 55. The groove 64 of one end portion of the guide 51 is received in a recess portion 68 in the plate 23. The other end portion of the guide 51 is rotatably received in an annular hole 69 in the bracket 55. The groove 64 in one end portion of the guide 52 is received in a recess 70 in the plate 23, and the groove 64 in the other end portion of the guide 53 is received in a reduced portion 71 of an opening 72 in the plate 23. A molded plastics outwardly projecting member or projection generally indicated at 73 is secured to the plate 23 by screws 74. The projection 73 includes a manually engageable tab or handle 75. By pulling outwardly on the handle 75, the plate 23, the bracket 55, the spindles 26 and 27, the spools 39 and 39′, the inking ribbon IR, and the guides 50 through 53 slide outwardly as a unit along a straight line from an operating position in which the ink ribbon IR in the space S (FIG. 1) to an open or threading position (FIG. 4) in which the ink ribbon IR is clear of the space S. The mounting plate 23, the guides 50 through 23, the spindles 26 and 27, the bracket 55 are considered to comprise a slide assembly SA.

A stationary bracket 76 suitably secured to the frame 11 mounts a detent generally indicated at 77. The detent 77 has a pair of opposed flexible resilient spring fingers or detent members 78 which selectively detent either with a pair of detent members 79 or with a pair of detent members 80. The detent members 78 cooperate with the detent members 79 when the slide assembly SA is in the operating position to releasably hold the slide assembly SA in the operating position, and the detent members 78 cooperate with the detent members 80 when the slide assembly SA is in the threading position to releasably hold the slide assembly SA in the threading position.

Figure 5:
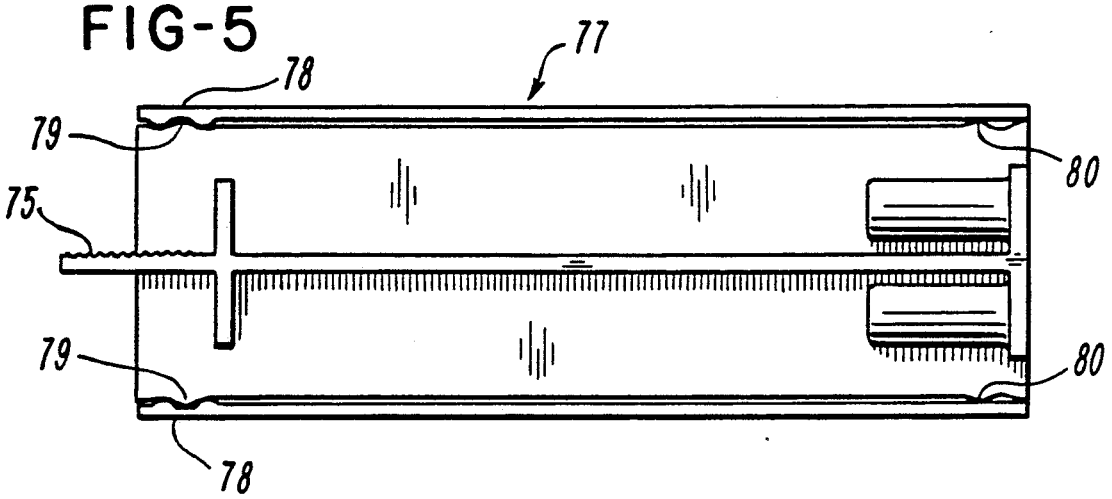
FIG. 5 is an enlarged elevational view showing the detent mechanism in detail.
Figure 6:
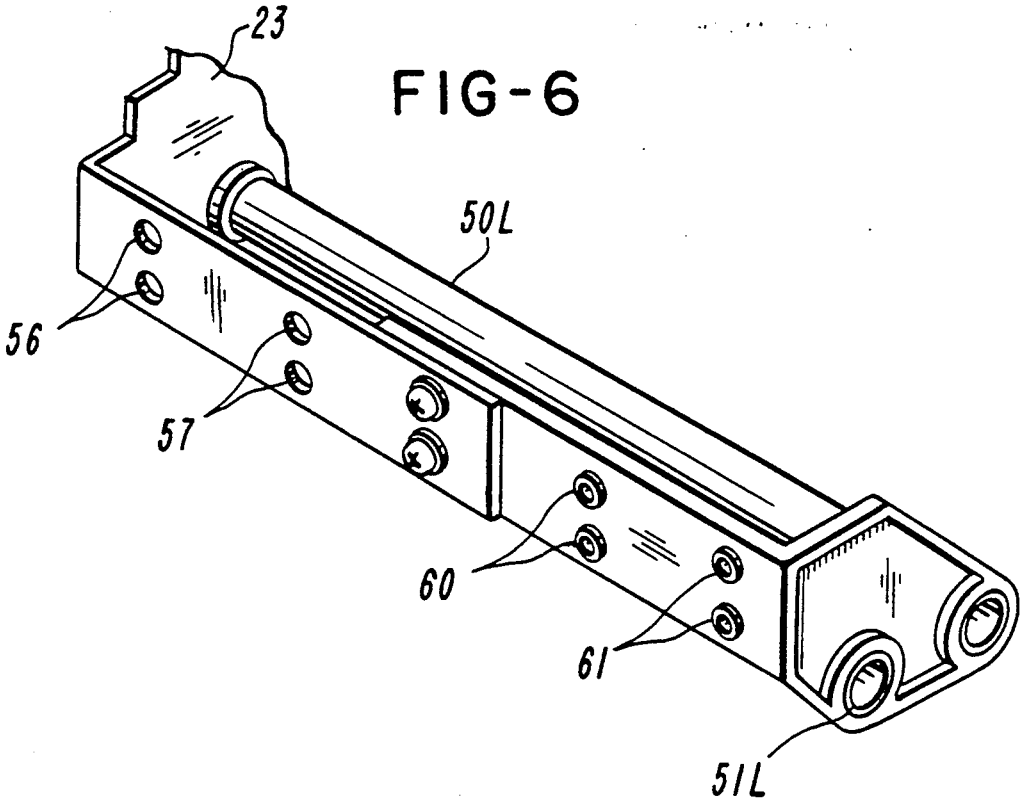
FIG. 6 is a fragmentary perspective view of structure for enabling inking ribbons of wider widths to be accommodated.

The invention is also adaptable to printers having print heads, platens and inking ribbons of different widths. For example, if the slide assembly SA is to be used in a printer having a wider print head and platen for use with a wider inking ribbon IR, the bracket 55 is adjusted so that the bracket 55 is secured to the tab 54 as shown in FIG. 6, namely, the screws pass through sets of holes 58 and 59 as shown in FIG. 5, or through sets of holes 57 and 60. Longer guides 50L and 51L are shown in FIG. 6. However, guides longer than the guides 50 through 53 are required and spindles longer than the spindles 26 and 27 are required. Also, a longer outwardly projecting member 73 with more widely spaced detent members is required.

In using the invention, the slide assembly SA is shown in its operating position in FIG. 1 in which the inking ribbon IR is in the clearance space or gap S between the print head 13 and the platen 14. The print head 13 is movable into the open position when the lever 16 is moved from the phantom line position to the solid line position. This facilitates threading of the record medium RM between the print head 13 and the platen 14 and enables the slide assembly SA to be readily slid from the operating position to the threading or loading and unloading position shown in FIG. 4. Once the record medium RM and the inking ribbon IR are in the operating or printing position, the lever 16 can be moved from the solid line position shown in FIG. 1 to the phantom line position, whereupon the print head 13 is moved into printing cooperation with the platen 14, with the inking ribbon IR in contact with the print head 13 and the record medium RM and with the record medium RM in contact with the platen 14.

During printing, the take-up shaft 18 rotates clockwise (FIG. 1) and causes the inking ribbon IR to be unwound from the supply roll R and to be wound onto the take-up roll R'. When the inking ribbon IR has been almost entirely used up from the roll R, printing is interrupted. To remove the spent ink ribbon, the lever 16 is first moved to the solid line position (FIG. 1) which moves the print head 13 to the position shown. Next the user grasps the handle 75 and pulls the entire slide assembly SA outwardly to the FIG. 4 position, in which the detent members 78 cooperate with detent members 80 to hold the slide assembly SA releasably in the threading position. The inking ribbon IR may now be conveniently removed and the spools 39 and 39' slid off the respective spindles 26 and 27. A new inking ribbon IR may now be loaded onto the spindle 26 and a new take-up spool 39' mounted onto the spindle 27. The free end of the inking ribbon IR can be threaded partly about guides 50 and 51, to partially about guides 52 and 53 and onto the take-up spool 39'. Thereupon, the handle 75 can be used to push the slide assembly SA from the position of FIG. 4 to the position of FIG. 1. When the lever 16 is again moved to the phantom line position, the printer is again ready to be operated to print on the record medium RM.

Other embodiments and modifications of the invention will suggest themselves to those skilled in the art, and all such of these as come within the spirit of this invention are included within its scope as best defined by the appended claims.

I claim:

1. A printer including a frame, a print head mounted on the frame, a platen cooperable with the print head to print on a record medium, the print head and the platen being relatively movable between an open position in which the print head and the platen are spaced apart to provide clearance space and a printing position in which the print head and the platen cooperate with the record medium and an inking ribbon to effect printing on the record medium, a supply roll spindle, a driven take-up spindle, means for guiding the inking ribbon along a path from the supply roll spindle, into alignment with the clearance space and to the take-up spindle, means for mounting the spindles and the guide means on the frame for movement as a unit only between an inking ribbon loading and unloading position and an operating position, whereby an inking ribbon supply roll can be loaded onto the mounting means so that the inking ribbon is aligned with the clearance space when the mounting means, the spindles and guide means are in the loading and unloading position, and whereby the mounting means, the spindles, the guide means and the inking ribbon supply roll are movable to the operating position to bring the inking ribbon into the clearance space.

2. A printer as defined in claim 1, wherein the print head is a cantilever-mounted thermal print head and the platen is a rotatable platen roll disposed parallel to the supply roll spindle.

3. A printer as defined in claim 1, wherein the mounting means includes a mounting member for mounting the guide means.

4. A printer as defined in claim 1, wherein the mounting means includes a mounting member for mounting the guide means, a supply roll shaft received in the supply roll spindle, means for slidably and drivingly coupling the supply roll spindle to the supply roll shaft, a take-up shaft received in the take-up spindle, and means for slidably and drivingly coupling the take-up spindle to the take-up shaft.

5. A printer as defined in claim 4, including means for selectively detenting the mounting member in either the loading and unloading position or in the operating position.

6. A printer as defined in claim 1, wherein the guide means includes a plurality of tubular guides, the mounting means includes a mounting member for mounting the tubular guides, a plurality of pins secured to the frame and received in the tubular guides, a supply roll shaft received in the supply roll spindle, means for slidably and drivingly coupling the supply roll spindle to the supply roll shaft, a take-up shaft received in the take-up spindle, means for slidably and drivingly coupling the take-up spindle to the take-up shaft, wherein the tubular guides are slidably mounted on the pins, and whereby the mounting member, the tubular guides and the spindles are slidably mounted for movement as a unit on the respective pins and shafts.

7. A printer as defined in claim 1, including means for enabling inking ribbons of different widths to be accommodated.

8. A printer as defined in claim 1, wherein the mounting means includes a plate having openings for rotatably receiving the supply roll spindle and the take-up spindle.

9. A printer as defined in claim 1, wherein the guide means includes a plurality of tubular guides, and wherein the mounting means includes a plate having openings for rotatably receiving the tubular guides and the spindles.

10. A printer as defined in claim 9, including pins mounted on the frame on which the tubular guides are slidably mounted.

11. A printer including a frame, a print head mounted on the frame, a platen cooperable with the print head to print on a record medium, the print head and the platen being relatively movable between an open position in which the print head and the platen are spaced apart to provide clearance space and a printing position in which the print head and platen cooperate with the record medium and the inking ribbon to effect printing on the record medium, a slide assembly slidably mounted on the frame for movement only between an inking ribbon loading and unloading position and an operating position, the slide assembly including a supply roll spindle, a driven take-up spindle, and means for guiding the inking ribbon along a path from the supply roll spindle, into alignment with the clearance space and to the take-up spindle, whereby an inking ribbon supply roll can be loaded onto the slide assembly so that the inking ribbon is aligned with the clearance space by the guide means when the slide assembly is in the loading and unloading position, and whereby the slide assembly is movable to the operating position to bring the inking ribbon into the clearance space.

12. A printer as defined in claim 11, including means for selectively detenting the slide assembly in either the loading and unloading position or in the operating position.

13. In combination, a supply ribbon spool, an inking ribbon wound into a supply roll and position on the supply ribbon spool, a take-up spool, a print head, a platen cooperable with the print head, the print head and the platen being relatively movable between an open position in which the print head and the platen are spaced apart to provide clearance space and a printing position, a supply roll spindle for mounting the supply ribbon spool, means for keying the ribbon supply spool to the supply roll spindle, a supply roll shaft which applies braking force to the supply roll spindle, means for slidably but non-rotatably mounting the supply roll spindle on and with respect to the supply roll shaft, a driven take-up spindle for mounting the take-up spool, a driven take-up shaft, means for slidably but non-rotatably mounting the take-up spindle on and with respect to the take-up shaft, means for guiding an ink ribbon along a path between the supply roll and the take-up spool, wherein a portion of the path is aligned with the clearance space, and means for connecting the spindles with the guide means for movement as a unit between an inking ribbon threading position wherein the inking ribbon is spaced from the clearance space and an inking position within the clearance space.

14. The combination defined in claim 13, wherein the means for keying the supply roll spool to the supply roll spindle includes a spline.

15. The combination defined in claim 13, wherein the means for keying the take-up spool and the take-up spindle includes a spline.

16. The combination defined in claim 13, wherein the means for keying the supply roll spool to the supply roll shaft includes a spline, and wherein the means for keying the take-up spool and the take-up spindle includes a spline.

17. The combination as defined in claim 13, wherein the means for keying the supply roll spool to the supply roll spindle includes a spline on the supply roll spool and a cooperating spline on the supply roll spindle.

18. The combination as defined in claim 13, wherein the supply ribbon spool includes means for providing an axially extending recess, and a mounting flange on the supply roll spindle received in the recess for mounting the supply ribbon spool.

19. The combination as defined in claim 13, wherein the supply ribbon spool includes means for providing an axially extending recess, a mounting flange on the supply roll spindle received in the recess for mounting the supply ribbon spool, and wherein the means for keying the supply roll spool and the supply roll spindle includes a loose-fitting spline connection.

20. The combination as defined in claim 13, wherein the take-up spool includes means for providing an axially extending recess, and a mounting flange on the take-up spindle received in the recess for mounting the take-up spool.

21. The combination as defined in claim 13, wherein the take-up spool includes means for providing an axially extending recess, a mounting flange on the take-up spindle received in the recess for mounting the take-up spool, and wherein the means for keying the take-up spool and take-up spindle includes a loose-fitting spline connection.

22. The combination as defined in claim 21, including a retainer including a sleeve for cooperating with the mounting flange on the take-up spindle to support the take-up spool on the take-up spindle.

23. Method of loading an inking ribbon into a printer, comprising the steps of: providing an inking ribbon wound into a supply roll, providing a take-up spool, providing a printer having a print head and a platen, the print head and the platen being relatively movable between a printing position and an open position, the print head and the platen being spaced apart in the open position to provide clearance space into which a portion of the inking ribbon is insertable, the printer having a supply spindle, a take-up spindle and guides mounted for shifting movement as a unit, the guides providing a guide path for the inking ribbon, a portion of the guide path being aligned with but spaced from the clearance space during threading of the ink ribbon along the path, inserting the supply roll onto the supply spindle, inserting the take-up spool onto the take-up spindle, thereafter threading the inking ribbon about the guides along the path, thereafter shifting the supply and take-up spindles and the guides as a unit to bring the aligned portion of the inking ribbon into the clearance space, and thereafter moving the print head and platen into the printing position with the inking ribbon in inking contact with a record medium.

24. Method as defined in claim 23, wherein the shifting step including shifting the spindles and the guides along a straight line.

25. Method of loading an inking ribbon into a printer, comprising the steps of: providing an inking ribbon wound into a supply roll and a supply spool, providing a take-up spool, providing a printer having a print head and a platen, the print head and the platen being relatively movable between a printing position and an open position, the print head and the platen being spaced apart in the open position to provide clearance space into which a portion of the inking ribbon is insertable, the printer having a supply spindle to which a braking force is applied, a driven take-up spindle and guides mounted for shifting movement as a unit, the guides providing a guide path for the inking ribbon, a portion of the guide path being aligned with but spaced from the clearance space during threading of the ink ribbon along the path, inserting the supply roll and its supply spool onto the supply spindle with the supply spool in keyed relationship with the supply spindle, inserting the take-up spool onto the take-up spindle with the take-up spool in keyed relationship with the take-up spindle, thereafter threading the inking ribbon about the guides along the path, thereafter shifting the supply and take-up spindles and the guides as a unit to bring the aligned portion of the inking ribbon into the clearance space, and thereafter moving the print head and platen into the printing position with the inking ribbon in inking contact with a record medium.

26. Method as defined in claim 25, wherein the shifting step includes shifting the spindles and the guides along a straight line.

* * * * *